US005887230A

United States Patent [19]

Sakamaki et al.

[11] Patent Number: 5,887,230

[45] Date of Patent: Mar. 23, 1999

[54] DRIVE MECHANISMS FOR USE WITH DRUM-LIKE IMAGE FORMING MEMBERS AND DRUM-LIKE IMAGE FORMING MEMBERS DRIVEN THEREBY

[75] Inventors: Katsumi Sakamaki; Akihiro Ida, both of Ashigarakami-gun; Kenichi Kobayashi, Ebina, all of Japan

[73] Assignee: Fuji Xerox Co., Ltd., Tokyo, Japan

[21] Appl. No.: 907,640

[22] Filed: Aug. 8, 1997

[30] Foreign Application Priority Data

| | | | |
|---|---|---|---|
| Aug. 13, 1996 | [JP] | Japan | 8-213865 |
| May 20, 1997 | [JP] | Japan | 8-130078 |

[51] Int. Cl.[6] ..... G03G 15/01

[52] U.S. Cl. ..... 399/167; 399/75; 399/299

[58] Field of Search ..... 399/37, 88, 149, 399/150, 159, 167, 297, 299, 300, 301, 75

[56] References Cited

U.S. PATENT DOCUMENTS

| | | | |
|---|---|---|---|
| 4,788,574 | 11/1988 | Matsumoto et al. | 399/300 |
| 4,796,050 | 1/1989 | Furuta et al. | 399/167 |
| 5,216,475 | 6/1993 | Ohne | 399/75 |
| 5,283,618 | 2/1994 | Hosoya et al. | 399/150 |
| 5,421,255 | 6/1995 | Kryk | 399/167 X |
| 5,708,949 | 1/1998 | Kasahara et al. | 399/330 |

FOREIGN PATENT DOCUMENTS

| | | |
|---|---|---|
| A1-4434081 | 5/1995 | Germany . |
| A-62-55674 | 3/1987 | Japan . |
| A-6-79917 | 3/1994 | Japan . |
| A-7-140844 | 6/1995 | Japan . |
| A-7-319254 | 12/1995 | Japan . |
| A-2185938 | 8/1987 | United Kingdom . |

*Primary Examiner*—Arthur T. Grimley
*Assistant Examiner*—Sophia S. Chen
*Attorney, Agent, or Firm*—Oliff & Berridge, PLC

[57] ABSTRACT

An image forming member 1 includes an image forming portion 12 for forming an image; a supported portion 10 which is rotatably supported by a bearing 14; and a driven portion 11 which receives a drive force by way of a drive force transmission member. The image forming section 12, the supported portion 10, the driven portion 11 are all made of the same base member having the same diameter. Further, the surface 10' of the supported portion 10 is supported by the bearing 14, and the surface 11' of the driven portion 11 receives the drive force.

11 Claims, 15 Drawing Sheets

FIG. 13
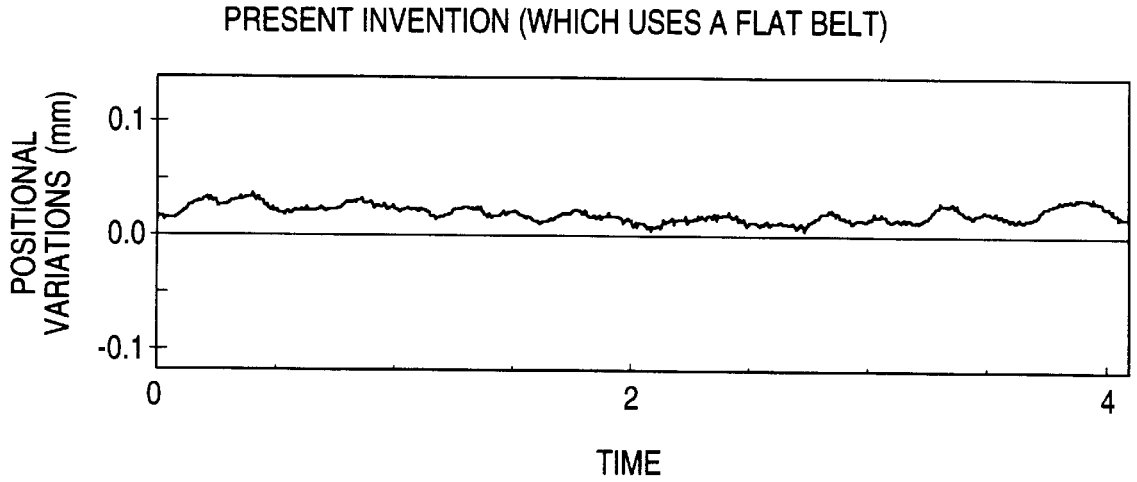
FIG. 14 (*Prior Art*)
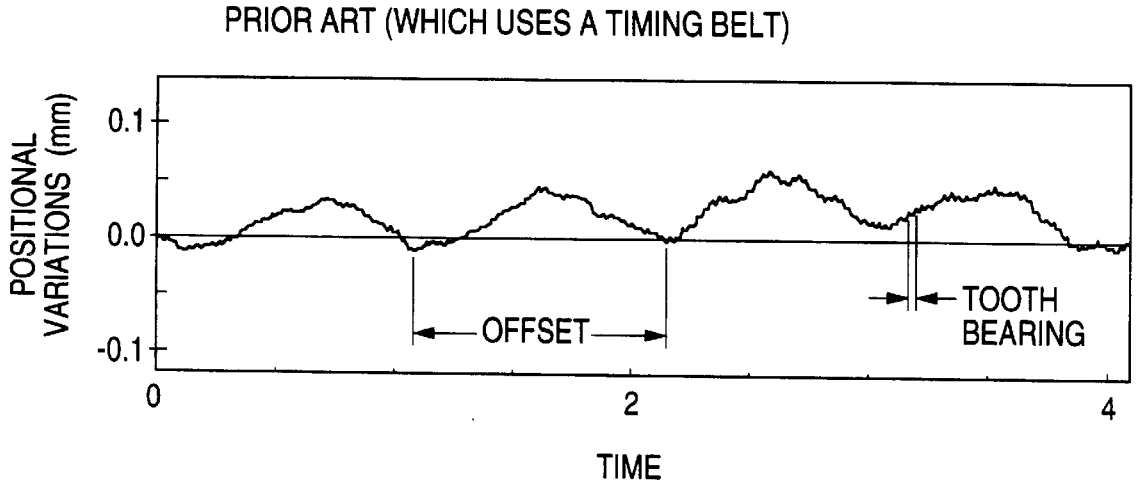

DRIVE MECHANISMS FOR USE WITH DRUM-LIKE IMAGE FORMING MEMBERS AND DRUM-LIKE IMAGE FORMING MEMBERS DRIVEN THEREBY

BACKGROUND OF THE INVENTION

1. Field of the Invention

The present invention relates to an image forming apparatus, such as electrophotographic printers, ionographic printers, ink-jet printers, or facsimiles, and more particularly to a drive technique suitable for use with tandem color copiers or color printers which employ a plurality of drum-like image forming members.

2. Description of the Related Art

Like electrophotographic printers, an apparatus which produces an image on recording paper is usually provided with an image forming member. An electrostatic latent image is formed on the surface of the image forming member while the image forming member is rotating, and the thus-formed latent image is developed by means of toner to thereby produce a developed image. In order to drive the image forming member in a rotating manner, the image forming apparatus is usually provided with a mechanism to transmit driving force to a drive shaft of the image forming member from a motor via a deceleration mechanism such as a gear or a timing belt so that the image forming member is rotated at a constant speed.

However, as can be seen from a schematic representation of a deceleration mechanism which employs gears shown in FIG. 29, in a case where a drive mechanism for use with the image forming member is constituted by interposing a deceleration gear unit which employs a combination of a plurality of gears 502 and 503 between a drive shaft 1*a* of the image forming member 1 and a motor 501, there will arise mechanical errors such as an offset "d" or meshing errors. As a result, variations as shown in FIG. 30 arise. Further, variations due to the offset of a pulley arise in the rotation of the rotation transmission mechanism that employs the timing belt. As described above, in the case of the conventional drive mechanism, variations arise in the rotational speed of the image forming member, which in turn pauses a problem for formation of a toner image.

This problem arises in the form of inconsistencies in density of an image for monochrome copiers or printers as well as in the form of imperfect images, such as variations in color or streaks of color, for color copiers or printers. For these reasons, it is desired to reduce variations in the rotational speed to as small an amount as possible, and consequently there has been a demand for a higher degree of accuracy of machining and assembly of the members of the drive mechanism.

However higher the accuracy of the drive mechanism may be improved, variations arise in the rotational speed of the image forming member, if the shaft of the motor or of the image forming member has an offset, or if the image forming member itself has an offset.

Japanese Patent Application Laid-open No. Hei-7-140844 discloses a sensing and controlling method as means for solving the foregoing problem. This method enables sensing and controlling of variations in the rotational speed of each of motors respectively attached to a plurality of image forming members by means of speed sensing means fitted to the drive shaft of each image forming member.

There is another known method in which positional information about image data to be finally output is sensed, and amendments are made to the timing at which an optical signal is output or to the trail of an optical axis. Japanese Patent Application Laid-open No. Hei-6-79917 discloses a method in which the displacements of toner on a transfer drum are sensed, and address offset data for each scanning line of a write beam is calculated from the result of the sensing operation and is then stored. The address of the write beam is corrected in the primary and secondary scanning directions.

Since the previously-described methods result in an increase in the size of the image forming apparatus or a significant increase in the cost, it is considerably difficult to apply the methods to inexpensive compact image forming apparatuses. Further, the methods suffer their insufficient versatility.

For example, Japanese Patent Application Laid-open No. Hei-7-319254 discloses a method in which an endless flat belt which is single transmission-and-drive means is brought into contact with the outer peripheral surface of a plurality of image forming members, and a rotational drive force is transmitted to a plurality of photosensitive drums by means of the frictional force developing between the outer peripheral surface of the photosensitive drums and the endless flat belt, whereby the outer peripheral surface of each of the photosensitive drums is actuated to the same extent.

Japanese Patent Application Laid-open No. Sho-62-55674 discloses a method intended for actuating each of a plurality of image forming members and a sheet conveyor belt to the same extent. By this method, the image forming members and the sheet conveyor/transfer belt are actuated in association with each other through use of a transmission member driven by a single drive source.

In both the previously-described existing methods disclosed in Japanese Patent Application Laid-open Nos. Hei-7-319254 and Sho-62-55674, exciting means, such as gears, which cause transmission of vibration are removed from a drive force transmission mechanism. Consequently, they are superior with regard to the reduction in the exciting components developing in the tooth bearings of the gears; and the prevention of variations in the rotation of the gear due to the exciting components and streaks of inconsistencies in color or density in a high frequency range.

As the reduction in the size and cost of the image forming apparatus has been improving in recent years in accordance with market demands, the image forming members and transmission members are also reduced in diameter. Accordingly, the number of rotations of these members is increasing. Further, in accordance with the increase in the number of rotations, variations in the rotation of the image forming member or transmission member due to the offset of the constituent elements are gradually increasing from a low frequency range to a higher frequency range. The pitch of variations-in-color resulting from the variations-in-rotation also becomes smaller, resulting in a tendency for the variations-in-color to become easily visually recognizable. For example, in the case of an existing image forming member having a diameter of 84 mm, if one variation arises in the image forming member every rotation, this variation appears in the form of a variation-in-color with a pitch of $84\times\pi=264$ mm; namely, in the form of a considerably mild variation. If the diameter is as small as 20 mm or 15 mm; particularly, if the diameter is 15 mm, the pitch of the variation-in-color becomes as narrow as $15\times\pi=47$ mm, thereby resulting in the variation-in-color being visually recognizable. Therefore, if consideration is given to the reduction in the size and cost of the image forming apparatus, a solution to variable components due to the offset of the image forming member presents a problem.

Neither the method disclosed in JP-A Laid-open No. Hei-7-319254 or the method disclosed in JP-A Laid-open No. Sho-62-55674 has means for removing the offset of the image forming member due to the positional offset or inclination of the support shaft of the image forming member. Consequently, in the methods disclosed in the foregoing Japanese Patent Applications, even if each image forming member is maintained at a constant rotational speed, the surface velocity of each image forming member at the position where a latent image is formed varies from image forming member to image forming member because of the offset of the image forming member with respect to its rotational center. Resultant color images are displaced from each other by an image transfer section when the image is transferred.

Elements in the variation in speed of the drive force transmission system from the drive source to the surface of the image forming member will be described.

FIG. 31 shows a schematic representation of an existing drive force transmission system.

In a case where the image forming apparatus has the drive force transmission system as shown in FIG. 31, the way the surface velocity $V_{PR}$ of the image forming member changes will be induced by Formula.

Assuming that a variation in each element is considered to be analogously represented by a sine vibration, and that disc-shaped flanges are attached to the rotational shaft of the image forming member. Further, assuming that a pipe-shaped photosensitive drum having a predetermined thickness $t_{PR}$ (mm) is fixed in such a way that the outer periphery of the flange comes into contact with the internal peripheral surface of the photosensitive drum.

Hereinafter, the amplitude of variation is $A_i$, the frequency of variation is $f_i$, and the phase of variation is $\Phi_i$ (suffix i designates each element).

First, with regard to the variation in a motor, assuming that a mean angular velocity is $\omega_{m0}$ [rad/sec], the angular velocity $\omega_m$ of the motor [rad/sec] is given by $$\omega_m=\omega_{m0}(1+A_1\sin(2\pi f_1 t+\Phi_1)) \quad (1)$$

Assuming that a mean radius of the motor shaft is $r_{m0}$ (mm), the radius of the motor shaft $r_m$ (mm) is given by $$r_m=r_{m0}(1+A_2\sin(2\pi f_2 t+\omega_2)) \quad (2)$$

Consideration will now be given to a deceleration apparatus. Here, assuming the reduction rate of two-stage deceleration of gears.

Reduction rate: $r_r$ is given by $$r_r=(r_{g1}/r_m)\times(r_{g3}/r_{g2}) \quad (3)$$

Assuming the mean radii of the respective deceleration means are $r_{g10}$, $r_{g20}$, $r_{g30}$ (mm), the radii $r_{g1}$, $r_{g2}$, $r_{g3}$ (mm) are given by $$r_{g1}=r_{g10}(1+A_3\sin((2\pi f_3 t+\Phi_3)) \quad (4)$$

$$r_{g2}=r_{g20}(1+A_4\sin((2\pi f_4 t+\Phi_4)) \quad (5)$$

$$r_{g3}=r_{g30}(1+A_5\sin((2\pi f_5 t+\Phi_5)) \quad (6)$$

With regard to the image forming member, the radius $r_s$ (mm) of the rotary shaft of the image forming member is given by $$r_s=r_{s0}(1+A_6\sin((2\pi f_6 t+\Phi_6)) \quad (7)$$

Assuming that the mean distance between the inner shaft of the flange to the outer periphery of the flange is $d_{f0}$ (mm), a distance $d_f$ (mm) is given by $$d_f=d_{f0}(1+A_7\sin((2\pi f_7 t+\Phi_7)) \quad (8)$$

Assuming that the mean thickness of the cylindrical photosensitive drum which constitutes the image forming member is $t_{PR0}$ (mm), a thickness $t_{PR}$ (mm) is given by $$t_{PR}=t_{PR0}(1+A_8\sin((2\pi f_8 t+\Phi_8)) \quad (9)$$

Assuming that the sum of the three elements described above is an effective radius, a surface velocity $V_{PR}$ (mm/sec) of the photosensitive drum is given by $$V_{PR}=\omega_m\cdot(1/r_r)\cdot(r_s+d_f+t_{PR}) \quad (10)$$

$$=\omega_m\cdot(r_{g1}/r_m)\cdot(r_{g3}/r_{g2})\cdot(r_s+d_f+t_{PR}) \quad (10')$$

As represented by Formula (10'), the surface velocity $V_{PR}$ of the photosensitive material is represented by a dependent function of each constituent element. Each element in Formula (10') includes a variation whose amplitude $A_i$ and phase $\Phi_i$ are arbitrarily given by the Formulae (1) through (9), and hence the final surface velocity $V_{PR}$ of the image forming member varies to a considerably large extent.

There is a drive method in which a single element is used for the motor and the deceleration mechanism. More specifically, in a case where an image forming apparatus has four image forming members, a drive motor and a deceleration mechanism are commonly used by the four image forming members. If this method is used as means for preventing the previously-described variation in the surface velocity of the image forming member, variations in independent variables: $\omega_m$, $r_m$, $r_{g1}$, $r_{g2}$, and $r_{g3}$ are brought in phase with each other with regard to the four image forming members. Accordingly, displacements of color which would be otherwise caused by variations in the variables can be prevented.

However, since the elements $r_s$, $d_f$ and $t_{PR}$ have various values in each of an image forming member, they cannot be removed by the foregoing existing drive method.

SUMMARY OF THE INVENTION

The present invention has been contrived in view of the aforementioned drawbacks, and the object of the invention is to provide an image forming apparatus which is capable of forming a high-quality image while preventing variable components of the elements $r_s$, $d_f$, and $t_{PR}$ from causing variations in density or color of an image.

To this end, in accordance with one aspect of the invention, there is provided an image forming apparatus including a drum-shaped image forming member having an image forming portion so that a latent image is formed on the surface of the image forming portion, the latent image is developed so as to produce a developed image on the surface of the image forming portion, and the developed image is finally transferred to predetermined paper, while the image forming member is rotating in a predetermined direction, a bearing which rotatably supports the image forming member, and drive means for imparting a drive force to the image forming member, wherein the image forming member further comprises, a supported portion being rotatably supported by the bearing and a driven portion being imparted a drive force by said drive means to rotate the image forming member, said supported portion and said driven portion being formed from the same base member having the same diameter as that of the image forming portion. As a result, even if the image forming member has imperfect circularity, the change in the circularity of the image forming member causes neither variations in the rotational speed of the image forming member nor variations in position on the surface of the image forming portion. More specifically, variations in density and color are not caused by the change in the circularity of the image forming member, whereby an extremely-high-quality picture without variations in density or color can be formed.

In the image forming member of the present invention, the drive means should preferably comprise a motor for generating a drive force, and an endless drive force transmission member which transmits the drive force to the image forming member from the motor by moving while remaining in contact with the surface of the driven portion of the image forming member.

With this configuration, there is prevented the change in the rotation of the image forming member due to an offset component caused as a result of the attachment of the drive force transmission member, such as a gear, to the end of the image forming member in the prior art, so that the image forming member can be driven at a uniform speed.

In a case where the image forming apparatus is provided with the endless drive force transmission member, the surface of the drive force transmission member which comes into contact with the surface of the driven portion should preferably be uniform in the longitudinal direction of the drive force transmission member, and the drive force transmission member should preferably transmit the drive force in the form of a frictional force to the image forming member from the motor.

The endless drive force transmission member includes an endless timing belt. The drive force is transmitted in the form of a frictional force from the motor to the image forming member through use of the endless drive force transmission member having a longitudinally-uniform surface, e.g., an endless belt or wire. As a result, the drive force of the motor can be transmitted to the image forming member in a smoother manner, and hence the change in the rotation of the image forming member can be prevented to a much greater extent.

In the image forming apparatus of the present invention, in a case where the image forming apparatus is provided with the endless drive force transmission member, the drive force transmission member should preferably be in contact with the driven portion in such a way that the image forming member experiences a force from the drive force transmission member so as to deflect in a predetermined direction, so that the supported portion press the bearing in the predetermined direction.

With this configuration, a variety of elements which affect the image forming portion of the image forming member, e.g., exposure or transfer, are always carried out at a predetermined point, and hence variations in density and color can be prevented to a much greater extent.

In the case where the image forming apparatus is provided with the endless drive force transmission member, the image forming apparatus should preferably comprise a plurality of image forming members, the motor which is shared between the plurality of image forming members, and the drive means which drive the plurality of image forming members by means of the drive force of the motor.

In the case where the plurality of image forming members are provided, and where the drive force is transmitted to the surface of the driven portion of each image forming member from the common motor by means of the drive force transmission member, the same surface velocity is ensured even if the image forming members are different in diameter from each other. The plurality of image forming members can be driven in a rotating manner at the same surface velocity. Variations in color of the color image are prevented, whereby high-quality color images are formed.

In the case where the image forming apparatus is provided with the plurality of image forming members and the endless drive force transmission member, the drive force transmission member should preferably be in contact with the driven portion of each of the plurality of image forming members in such a way that the plurality of image forming members experience a force from the drive force transmission member so as to deflect in a predetermined direction, so that the supported portion of the plurality of image forming members press in the predetermined direction the bearings supporting the supported portion.

With this configuration, an exposure point or a transfer point is fixed at an identical point not only for each of but for a plurality of image forming members, whereby variations in color of a color image are prevented to a much greater extent.

Further, the image forming apparatus should preferably further comprise fine particle imparting means which is provided on the image forming member so as to impart fine particles to the image forming member before or at the same that the developed image is formed on the image forming member.

With such a fine particle imparting means, the efficiency of transfer of the developed image formed on the image forming member is improved, and the amount of the residual toner left on the image forming member after the transfer is reduced. Therefore, there is eliminated the need for a cleaner for removing the residual toner left on the image forming member after the transfer operation.

BRIEF DESCRIPTION OF THE DRAWINGS

FIG. 13 is a plot showing positional variations per time in accordance with the present invention;

FIG. 14 is a plot showing positional variations per time in accordance with the prior art;

DETAILED DESCRIPTION OF THE PREFERRED EMBODIMENTS

Preferred embodiments of the invention will be described hereinbelow.

Figure 1:
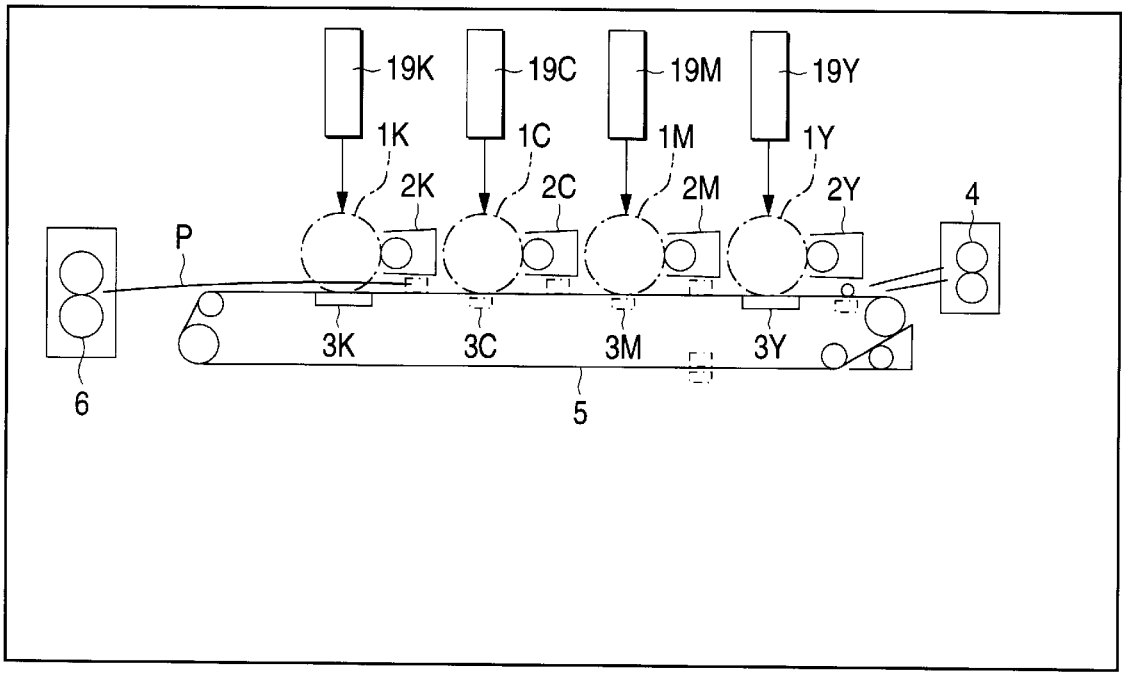
FIG. 1 is a schematic representation of a tandem color copier to which the present invention is applied.

FIG. 1 is a schematic representation of a tandem color copier in accordance with one embodiment of an image forming apparatus of the present invention, wherein image forming members which produce images in respective colors are arranged in parallel with each other.

The image forming apparatus shown in FIG. 1 has four image forming members 1Y, 1M, 1C, 1K provided at given intervals in parallel with each other. A yellow toner image, a magenta toner image, a cyan toner image, and a black toner image are formed on the respective surfaces of the four image forming members 1Y, 1M, 1C, 1K. The surfaces of the image forming members 1Y, 1M, 1C, 1K are uniformly electrified by electrostatic chargers (not shown) and are then exposed to exposure light from exposure devices 19Y, 19M, 19C, 19K made up of a semiconductor laser or the like, whereby electrostatic latent images are formed on the surfaces of the image forming members. The electrostatic latent images formed on the respective surfaces of the image forming members 1Y, 1M, 1C, 1K are developed by toner in respective colors, i.e., yellow, magenta, cyan, and black, whereby visible toner images (developed images) are produced. These visible toner images are transferred in order to paper P by means of electrification of transfer devices 3Y, 3M, 3C, 3K.

The paper P on which the toner images are transferred in order from the image forming members 1Y, 1M, 1C, 1K is supplied from a paper feed cassette (not shown) to transfer positions of a transfer belt 5 formed downstream from the respective image forming members 1Y, 1M, 1C, 1K in order via a registration roller 4 while being electrostatically retained. Color toner images are transferred to the paper P in order from the respective image forming members 1Y, 1M, 1C, 1K. The paper P on which the color toner images have been transferred from the image forming members is released from the transfer belt 5 and then conveyed to a fixing unit 6. The color toner images superimposed on the paper P are fixed as a color image by the fixing unit 6.

Electric charges are removed from the image forming members 1Y, 1M, 1C, 1K that have finished transferring their toner images by electric-charge-removing devices (not shown), and residual toner is removed from the same by cleaning devices (not shown). Subsequently, the image forming members are again illuminated by erase lamps 2Y, 2M, 2C, 2K to thereby become ready for the next image forming operation.

The embodiment shown in FIG. 1 is arranged such that paper is retained on the transfer belt in a sucked manner, and color toner images formed on the image forming members 1Y, 1M, 1C, 1K are superimposed on the paper. The present invention is not limitedly applied to the image forming apparatus having the foregoing configuration, but may be applied to an image forming apparatus arranged in such a way that color toner images are directly transferred to intermediate transfer belts or intermediate transfer drums, and they are collectively transferred to and fixed on the paper after having been superimposed on each other.

Figure 2:
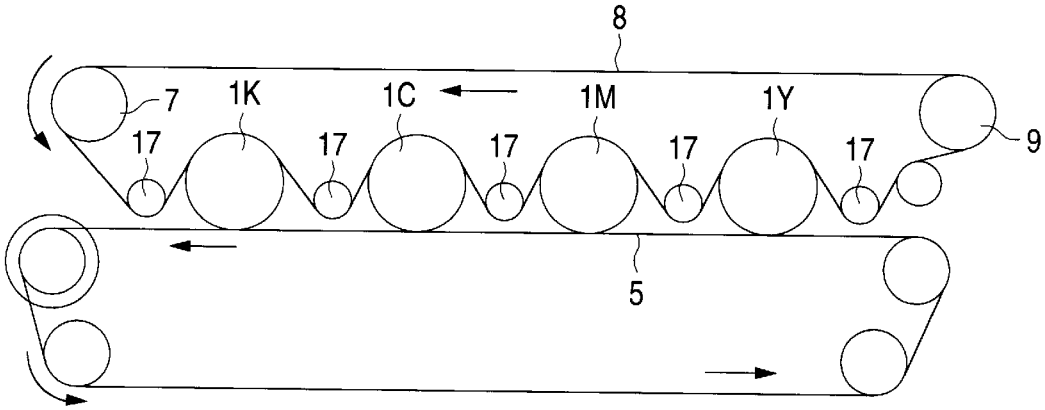
FIG. 2 is a schematic front view showing one embodiment of a drive force transmission structure.
Figure 3:
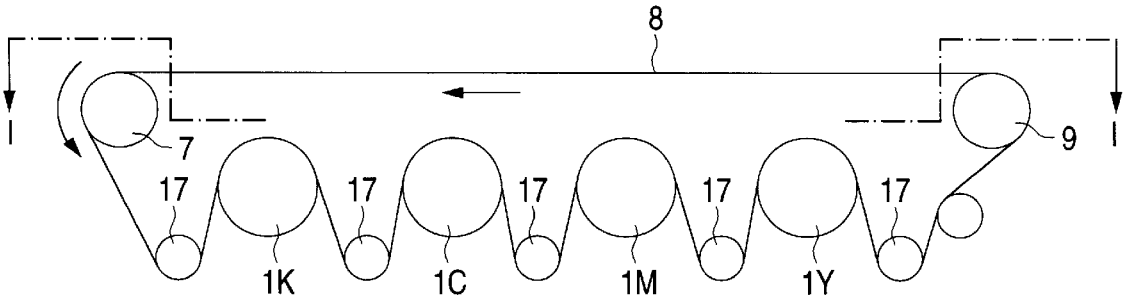
FIG. 3 is a schematic representation showing a drive force transmission mechanism of an image forming member.
Figure 4:
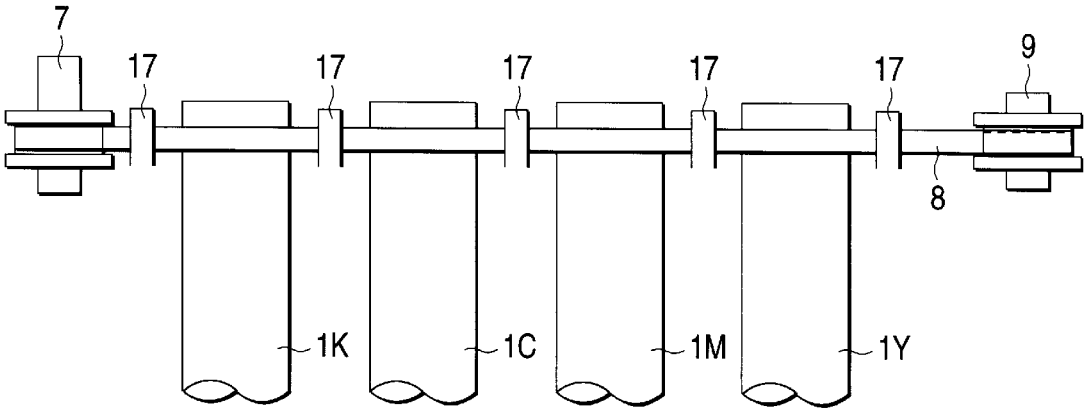
FIG. 4 is a top view when viewed in the direction designated by arrow I—I in FIG. 3.

FIG. 2 is a schematic representation showing, together with a transfer mechanism, one embodiment of a drive force transmission structure of the image forming apparatus for rotatably driving the image forming members. FIG. 3 is a schematic representation showing only the construction of the drive force transmission the image forming apparatus. FIG. 4 is a plan view viewed in the direction designated by an arrow line I—I in FIG. 3.

In FIG. 2, the drive force transmission structure includes a drive roller 7 which rotates upon receipt of drive torque from a single motor (not shown); an endless drive force transmission member 8 which is wrapped around the drive roller 7; a tension roller 9 which applies a predetermined tensile force to the drive force transmission member 8; and wrap-angle setting rollers 17 for wrapping the drive force transmission member 8 around the circumferential surfaces of the image forming members 1Y, 1M, 1C, 1K at predetermined wrap angles. With this construction, the drive force transmission member 8 is brought into contact with the image forming members 1Y, 1M, 1C, 1K under pressure. Drive torque is transmitted from the motor to the image forming members by means of a frictional force developing between the surfaces of the image forming members 1Y, 1M, 1C, 1K and the drive force transmission member 8.

Figure 5:
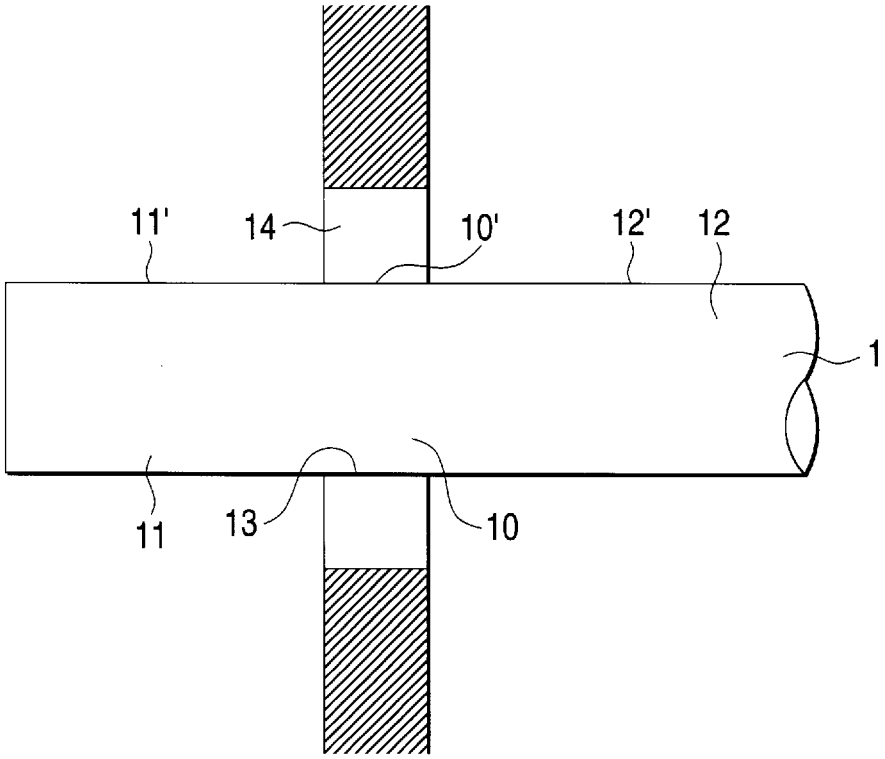
FIG. 5 is a schematic representation showing the drive force transmission mechanism of the image forming member.

FIG. 5 is a schematic representation showing the construction for supporting the image forming member. In an image forming member 1, the surface 10' of a supported portion 10 to be supported by a bearing 14, the surface 11' of a driven portion 11 to be rotatably driven by the image forming member 1, and the surface 12' of an image forming portion 12 which forms an image are flush with each other. The surface 10' of the supported portion 10 which is one part of the image forming member 1 is supported by the bearing 14 having a slidable surface 13 which receives the rotation of the image forming member 1 in a supporting manner.

As shown in FIG. 5, it is only essential for the image forming member 1 to have a single diameter common to the image forming portion 12 which forms an image, the supported portion 10 to be supported by the bearing, and the driven portion 11 which a drive torque transmitted from the belt is applied. It is not necessary to integrate all the diameters of the elements of the overall image forming member 1 into a single diameter. For example, a gear for transmitting a rotating torque to another rotating member or a shaft which is different in diameter from the image forming member may protrude from the end of the image forming member 1.

Although not shown in the drawing, in the image forming portion 12 of the image forming member 1, a charge-generation layer and a charge-transfer layer are provided on an upper part of a metal base. A coating layer is also provided on the charge-generation or charge-transfer layer as required. In a strict sense, the image forming portion and the other portion of the image forming member are slightly different in diameter from each other. However, the previously-described layers relevant to the formation of an image are thinly and very uniformly formed. In practice, the layers do not cause offset components. For this reason, in the present invention, it is only essential for the image forming portion 12, the supported portion 10, and the driven portion 11 to be made of the same base member having the same diameter. The difference between the diameters of these members due to the presence of a coating layer provided on the base member do not present any problem.

It is desirable that the surface 11' of the driven portion 11 of the image forming member 1 should possess a high coefficient of friction with respect to the belt so that the torque transmitted from the belt can effectively act on the driven portion 11. To this end, minute bumps and dips may be formed on the surface 11' of the driven portion 11, or the surface 11' may be coated with a material having a high coefficient of friction. During the assembly, the bearing 14 is fitted to the supported portion 10 after having passed over the driven portion 11. Therefore, the ease of attachment/detachment of the bearing 14 to the image forming member 1 must be taken into consideration.

In consideration of the foregoing point, it is desirable to form the base member of the driven portion 11 to have a smaller diameter than that of the base member of the other base member in such a way that the diameter of the finished driven portion 11 becomes slightly smaller than the diameter of the remaining portion (e.g., 1–100 $\mu$m or thereabouts). Such a slight difference in diameter intended to ensure the ease of attachment/detachment of the bearing does not cause offset components which would result in a practical problem. For this reason, "the same diameter" used herein is not limited to "completely the same diameter," but includes a slight difference in diameter to the previously-described extent.

Figure 6:
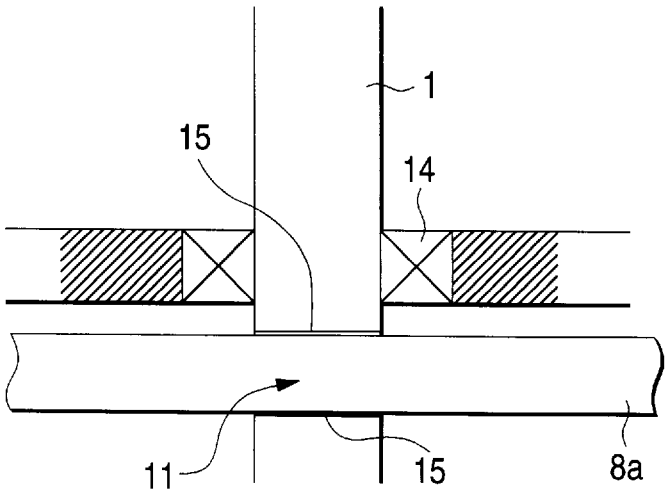
FIG. 6 is an enlarged plan view of the drive force transmission mechanism of the image forming member.
Figure 7:
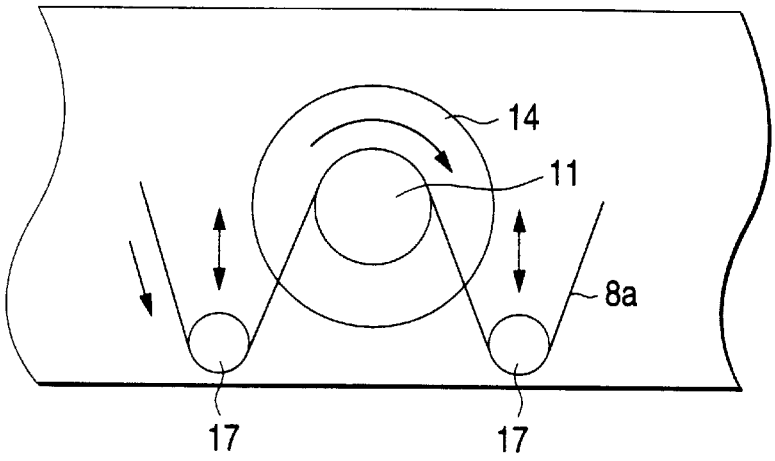
FIG. 7 is an enlarged front view of the drive force transmission mechanism of the image forming member.

FIG. 6 is an enlarged view of one drive force transmission mechanism for driving the image forming members in a rotating manner. FIG. 7 is a front view of the same, and the overall structure of the drive force transmission mechanism is provided in FIG. 2.

FIGS. 6 and 7 show an endless belt 8*a* which is one example of the drive force transmission member 8 and is wrapped around and brought into contact with the driven portion 11 of the image forming member 1. In wrapping the endless belt 8*a* around the driven portion 11 of the image forming member 1, for example, a step shown in FIG. 4 is formed in the drive roller 7 or the tension roller 9 in order to prevent the endless belt 8*a* from moving to one side of the image forming members or from snaking across the same.

Alternatively, as shown in FIG. 6, a stopper material 15 may be provided on one side or both sides of the driven portion 11 of the image forming member 1 in order to prevent the endless belt 8*a* from becoming offset to one side of the image forming members or from snaking across the same.

The rotating torque is transmitted to the image forming member 1 by means of a frictional force caused by the pressure of the drive force transmission member 8 which comes into pressed contact with the driven portion 11 of the image forming member 1. Accordingly, the torque is significantly affected by the angle at which the drive force transmission member 8 is wrapped around the driven portion 11 of the image forming member 1 and the tensile force of the tension roller 9 (see FIG. 4) from a mechanical viewpoint, as well as by the coefficient of friction between the members to be used from the viewpoint of material.

The material of the drive force transmission member includes a metal belt having a stable degree of accuracy which is formed from stainless steel, phosphor bronze, nickel or the like, and a flat belt constructed by a braided fibrous-core material coated with urethane resin. It is preferable to use, as the fiber, metal or Kevler fiber which has a high strength but extends less. The pulley is the base member of the image forming member 1 and may be formed from stainless steel, aluminum, aluminum alloys, or iron-based metallic materials. As a matter of course, bumps and dips may be formed on the surface of the base member so as to improve the characteristics of the surface (i.e., to increase the coefficient of friction) by coating the surface with a thin coating film, sand-blasting, or etching. In this case, if the thickness of the coating layer is within the range of tens to hundreds of microns, unevenness in the thickness of the coating layer will not affect the operation of the image forming member and will not cause any offset components.

A test which will be described later was carried out while the drive force transmission mechanism of the image forming apparatus shown in FIG. 2 was actuated. The image forming apparatus used in the test includes image forming members which have a diameter $\omega$ of 10 to 30 mm and are arranged with pitches of 20 to 50 mm. These image forming members were rotated at 50 to 150 mm/s, and in this test, variations in the rotation of the image forming member 1K were measured through use of an unillustrated rotary encoder attached to the image forming member 1K. The base member of the image forming members is formed from stainless steel. A general-purpose stepping motor (not shown) was used as a drive source of the image forming members. The drive force transmission belt 8 is wrapped around the pulley 7 (see FIGS. 3 and 4) which is integrally formed with a decelerator by way of the decelerator. As shown in FIG. 4, this drive force transmission belt 8 is arranged so as to come into contact with the edge of each of the image forming members 1 which is a slidable surface. An endless stainless-steel belt which has the width ranging from 3 to 10 mm and the thickness ranging from 40 to 80 microns was used as the drive force transmission belt 8. The drive force transmission belt 8 was brought into contact with the base members of the image forming members at an angle (i.e., a wrap angle) of about 100 to 150 degrees, and the tensile forth of the belt was set to 15 to 30N. With this configuration, the results of the test were measured.

Figure 8:
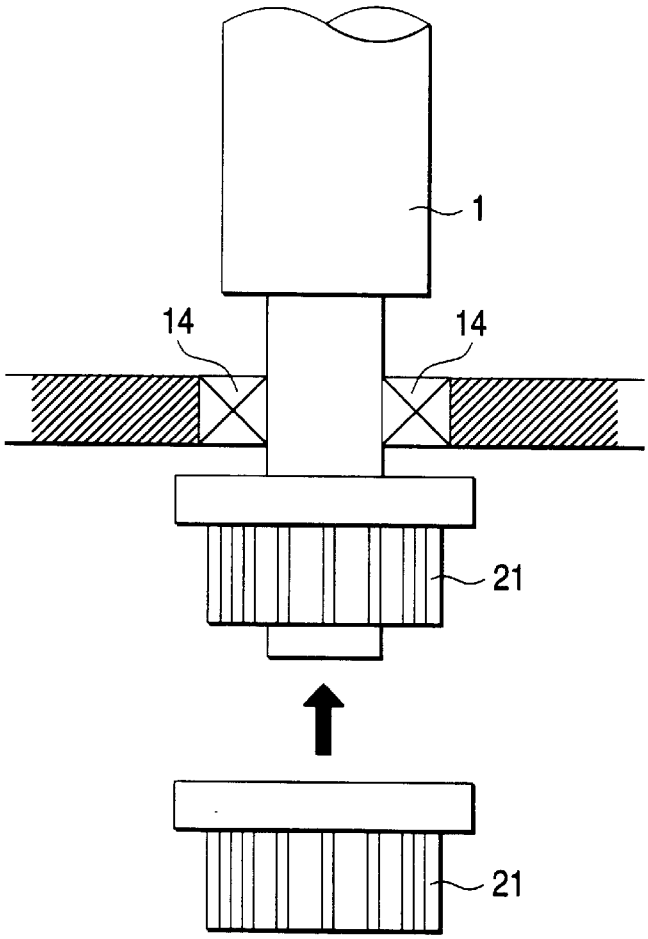
FIG. 8 (Prior Art)
FIG. 8 is an enlarged front view of a drive force transmission mechanism in the prior art.
Figure 9:
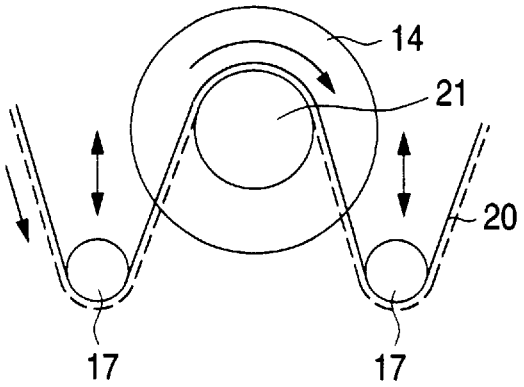
FIG. 9 (Prior Art)
FIG. 9 is an enlarged plane view of the drive force transmission mechanism in the prior art.

For comparison with the results of the test of the present invention, gear pulleys 21 manufactured independently of the image forming members 1 were used in the test apparatus, and a timing belt 20 was used as the drive force transmission belt 8. Then, the results of operation of the image forming members were measured. As shown in FIGS. 8 and 9, the gear pulley 21 that is manufactured independently of the image forming member 1 and has a pitch diameter being substantially the same as that of the image forming member 1 is attached to the end of the image forming member 1. The timing belt 20 which serves a drive force transmission belt is wrapped around the gear pulley 21. The timing belt 20 is a commercially-available timing belt which is formed from chloroprene rubber, glass fiber cords, aramide cords, or nylon canvas and has a width of 4 mm and a gear pitch of 1.5 mm. This comparative example was measured so that the remaining setting and measurement conditions are the same as those of the previously-described test.

The technique of the present invention will be theoretically represented by Formula.

Figure 10:
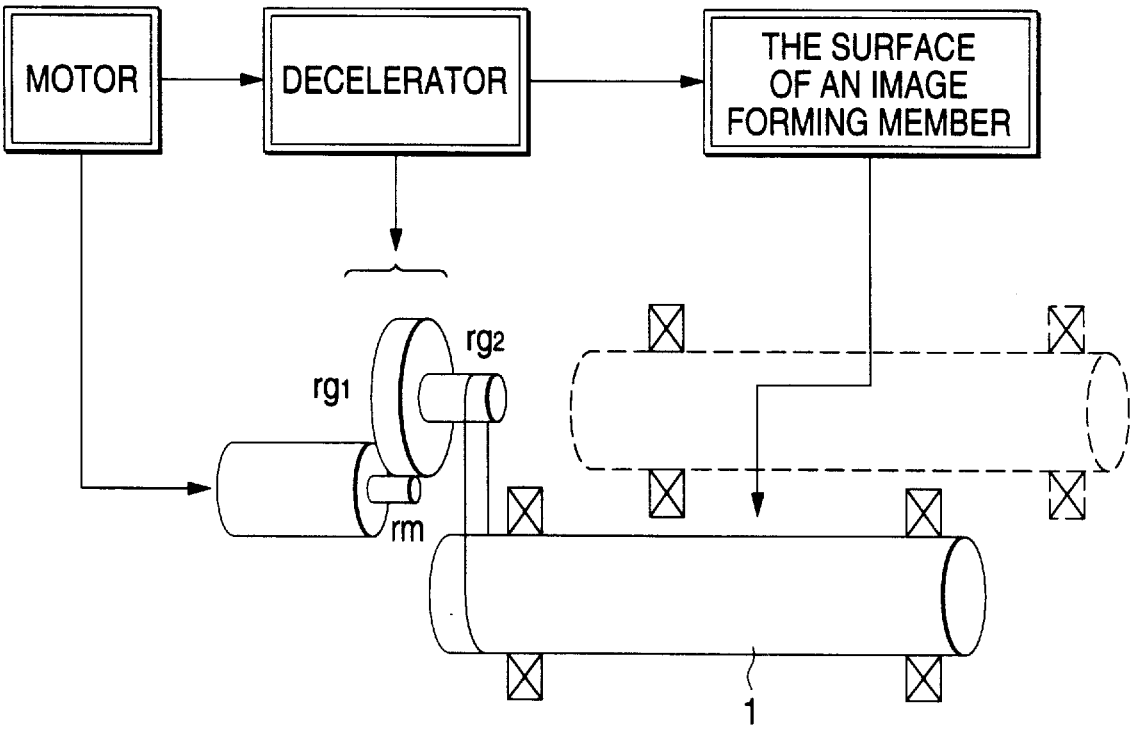
FIG. 10 is a schematic diagram which illustrates variation elements developing in the mechanism from a drive source to the surface of a photosensitive material in the present invention.

FIG. 10 is a schematic representation showing variable elements in a drive system in accordance with the present invention from a drive source to the surface of the image forming member.

Variations in the independent variables related to the motor and a part of the decelerator are the same as those represented by Formulae (1) through (5).

The drive system is different from the existing drive system with regard to a method of actuating an image forming member and a method of geometrically supporting the image forming member. In the drive system shown in FIG. 10, since the drive force transmission member is directly wrapped around the surface of the image forming member, and the drive force transmission member is directly supported by the surface of the image forming member in a rotating manner, it is not necessary take into account the thickness of the flange or the photosensitive drum.

The surface velocity $V_{PR}$ (mm/sec) of the image forming member is equal to the transfer velocity $V_{wire}$ of a wire' (or a belt member) which is means for rotating the surface of the image forming member in a rotating manner. Since $V_{wire}$ is a rotational and peripheral speed produced at the output portion of the decelerator, it is given by $$V_{wire}=V_{PR}=\omega_m\cdot(r_{g1}/r_m)\cdot r_{g2} \quad (11)$$

Formula (11) does not contain the geometrical size of the image forming member as a variable. With regard to the terms of the formula; i.e., the elements $\omega_m$, $r_m$, $r_{g1}$, $r_{P2}$ relevant to the motor and the decelerator, if there is employed a method in which a single element is used as a variable component, that is, a method in which the drive motor and a deceleration mechanism are shared among the four image forming members, the elements can be brought into phase with each other with respect to the four image forming members. Accordingly, Formula (11) shows that the image forming apparatus as a whole does not cause variations in color.

As has been described above, in comparison with the existing technique, it is seen that the present invention is also superior from a theoretical viewpoint.

Table 1 shows the results of the test which uses a flat belt and the results of the test for the purposes of comparison which uses a timing belt and the independent pulleys, in the prior art, fitted to the image forming members of the same test apparatus. There are also provided the data on a color copier in the prior art which is a real product equipped with a gear train type drive force transmission mechanism. Here, the numerical values related to the drive force transmission mechanism of this gear train type were obtained when the image forming apparatus had carried out correction control operations.

TABLE 1

The cause of variations and the result of operation for each drive force transmission method

| Transmission method | Cause of variation: Tooth-bearing components of a P/R drive (a rate of variation in speed (%)) | Cause of variation: Rotational frequency components of P/R (a positional variation (μm)) |
|---|---|---|
| Prior Art A (Actuated through use of a timing belt) | 0.22 | 23 |
| Prior Art B (Actuated through use of gears/correction was made to the actuation) | 0.15 | 15~20 |
| Present Invention (Actuated through use of a flat belt) | 0 | 1.8 |

Numerical values listed in Table 1 include numerical values which are obtained by subjecting the data on the rotational speed of the image forming member to FFT analysis to thereby obtain the exciting frequency components (tooth-bearing components of a P/R (photoreceptor) drive) of the image forming member drive system; and numerical values which are obtained by converting the data on variations in the rotational speed of the image forming member into positional-variation data by integration, and by subjecting the positional-variation data to FFT analysis to thereby obtain offset frequency components (rotational frequency components of a P/R).

Figure 11:
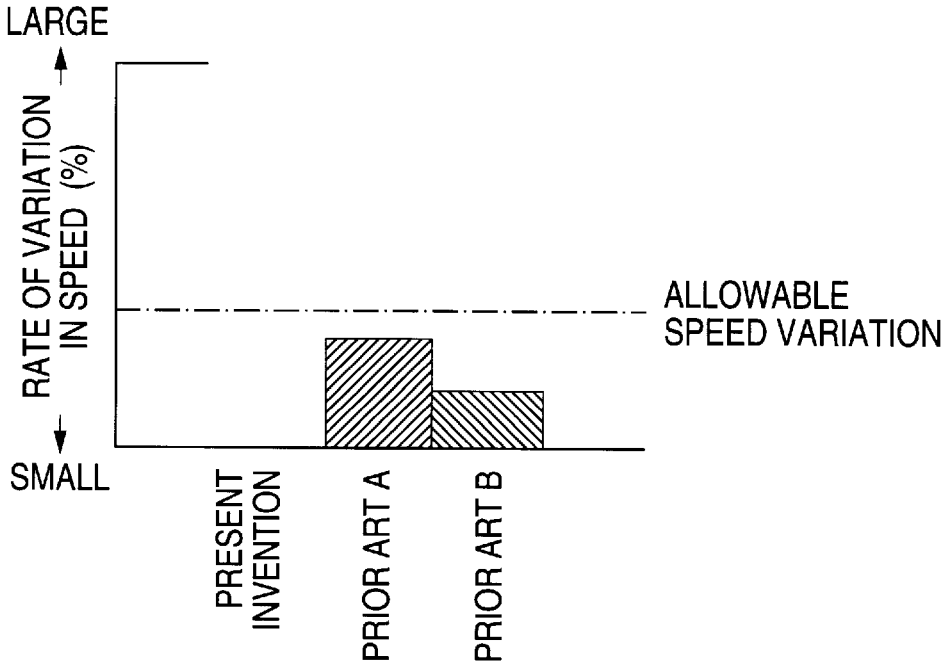
FIG. 11 is a plot showing the comparison between the present invention and the prior art with regard to variations in speed.

FIG. 11 is a plot showing data concerning the rate of variations in speed due to the exciting frequency components (tooth bearing components) of the image forming member drive system represented by the numerical values in Table 1 with respect to the drive force transmission methods. As can be seen from the plot, the exciting frequency components (the tooth bearing components) obtained by any of the drive methods are less than the allowable variations in speed. Of these test results, the test result of the present invention that uses the flat belt is the best. The data obtained by the existing method B that employs gear-train operations is a result of correction control. The test result of the existing method B will be deteriorated by about 10 times unless the method employs correction control.

Figure 12:
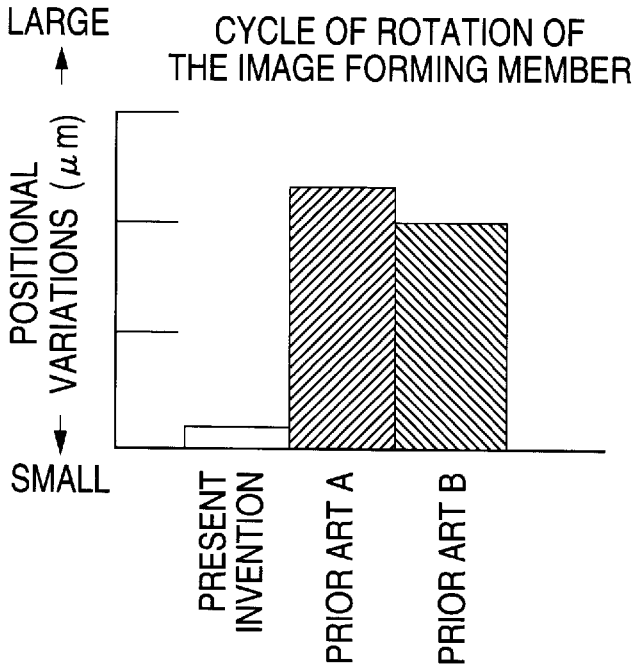
FIG. 12 is a plot showing the comparison between the present invention and the prior art with regard to positional variations in the outer peripheral surface of the image forming member.

FIG. 12 shows the data, numerically shown in Table 1, concerning positional variations due to the offset components of the image forming member in accordance with the drive transmission methods. As can be seen from the drawing, the test result of the present invention that uses a flat belt shows that the shaft of the image forming member does not have any specific center of rotation because the supporting method which the outer peripheral surface of the image forming member is supported, and the driven method which the outer peripheral surface of the same is actuated are applied. Consequently, very few offset components occur.

In contrast, for the case of the existing drive method in which a timing belt is used, the drive pulley is formed independently of and fixed to the image forming member. The displacements of the center of rotation of the shaft between the drive pulley and the image forming member result in offset components, and the thus-generated offset components noticeably appear as positional variations. The same applies to the case of the gear-train drive method.

FIG. 13 shows data concerning positional variations corresponding to about four rotations of the image forming member in the case where the flat belt is used. FIG. 14 shows data concerning positional variations corresponding to about four rotations of the image forming member in the case where the timing belt is used. As can be seen from these drawings, in the existing drive method in which a timing belt is used, it can be acknowledged that there are the positional-variation components due to the offset of the image forming member and the positional-variation components due to the tooth bearing of the gear which are the exciting components of the drive system.

Since the image forming member is actuated at a given wrap angle by the drive force transmission member in the present embodiment, the center of rotation is defined by the mean of the area of the drive force transmission member wrapped around the image forming member even if the image forming member has imperfect circularity. Accordingly, in comparison with a gear which is a point-contact transmission member, variations in the center of rotation due to the imperfect circularity of the image forming member can be suppressed to a small extent.

As a result, in the present embodiment, even if the circularity of the image forming member is imperfect, the center of rotation of the image forming member matches the support center of the bearing, resulting in greater allowance with respect to the reduction in the dimensional accuracy of the image forming member.

Figure 15:
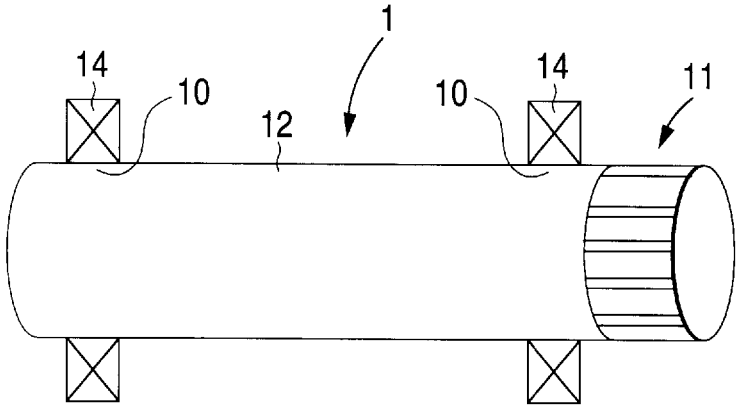
FIG. 15 is a perspective view showing the image forming member in accordance with another embodiment of the present invention.
Figure 16:
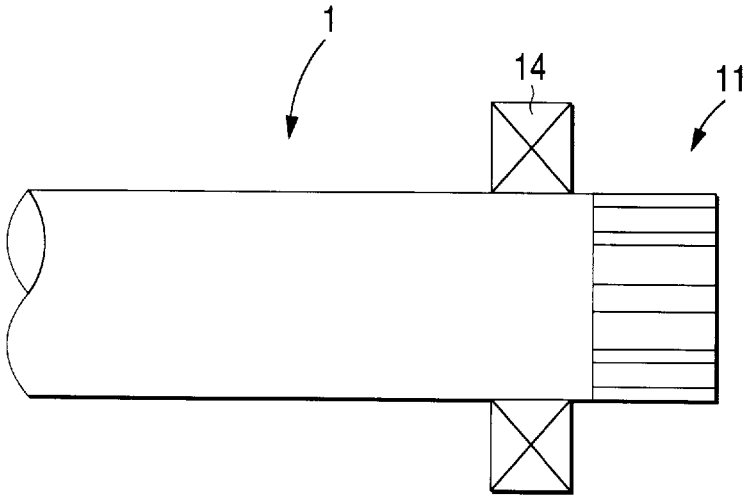
FIG. 16 is a partial plan view of the image forming member in FIG. 15.

FIG. 15 is a perspective view of an image forming member of the image forming apparatus in accordance with another embodiment of the present invention, and FIG. 16 is a partial front view of the same.

The image forming member 1 shown in these drawings includes an image forming portion 12 for forming an image, two supported portions 10 which are supported by bearings 14, and a driven portion 11 which receives the torque of the image forming member 1. All of these elements; namely, the image forming portion 12, the driven portion 11, and the two supported portions 10 are formed from the same material through a series of processing; e.g., machining operations, electrical-discharge machining operations, abrasion, or plasticity processing. In the driven portion 11, gears having a pitch which matches with a pitch of a timing belt are cut so as to be driven by the timing belt (not shown).

In this case, there does not occur the eccentric tolerance resulting from connection of or attachment of another constituent element to the image forming member as shown in FIG. 8, so that the accuracy of machining can be improved to a much greater extent. Consequently, the radius of rotation of the image forming portion 12, the radii of rotation of the supported portions 10 supported by the bearings, and the radius of rotation of the driven portion 11 which receives torque are brought into alignment with the single center of rotation, thereby resulting advantageous effects of the present invention.

Even in the present embodiment, there still exist the positional variations due to the tooth bearing components developing between the pulley and the timing belt. In comparison with the positional variations due to the offset cycle, these positional variations have a higher frequency. Therefore, if the timing belt has small pitches, positional variations which would occur become small and fall within an allowable range (see FIG. 11).

Figure 17:
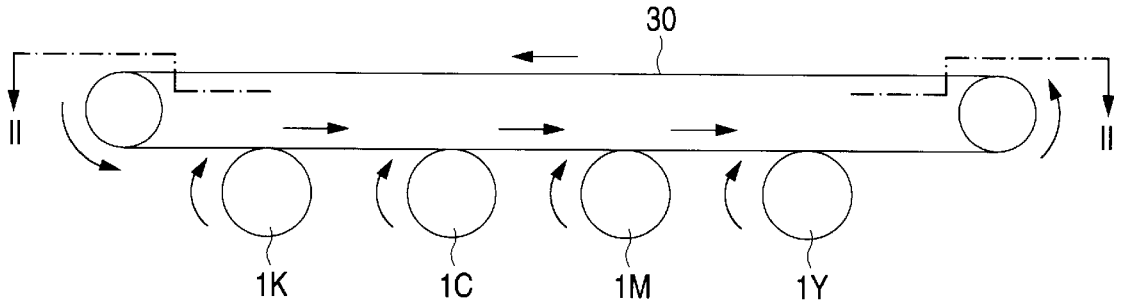
FIG. 17 is a schematic representation showing another embodiment in which the image forming member is driven in a rotating manner.
Figure 18:
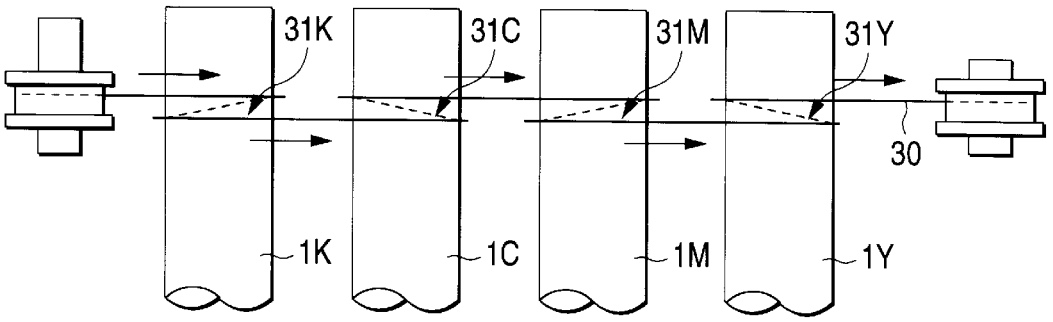
FIG. 18 is a top view when viewed in the direction designated by arrow II—II in FIG. 17.

FIG. 17 is a schematic representation showing another embodiment of the image forming apparatus in which the image forming members are driven in a rotating manner. FIG. 18 is a top view of the image forming apparatus in FIG. 17 when viewed in the direction designated by line II—II. As shown in the drawings, in the present embodiment, an endless wire 30 which serves as the drive force transmission member is wrapped around the surfaces of driven portions 31Y, 31M, 31C, 31K which are the drive force transmission surfaces of the drive force transmission surfaces 1Y, 1M, 1C, 1K, whereby the image forming members 1Y, 1M, 1C, 1K are driven in a rotating manner. One exemplary method of wrapping the wire 30 around the driven portions of the image forming members is a method shown in FIG. 18 in which the wire 30 is alternately wrapped around each of the image forming members 1Y, 1M, 1C, 1K to thereby prevent the wire 30 from moving to one side of the image forming members or snaking across the same. Similar to the previous embodiment, a frictional transmission force to be transmitted to the image forming members is significantly affected by the angle at which the drive force transmission member (e.g., the wire 30) is wrapped around the driven portions of the image forming members and the tensile force of the drive force transmission member from a mechanical viewpoint, as well as by the coefficient of friction between the members to be used from the viewpoint of material.

Figure 19:
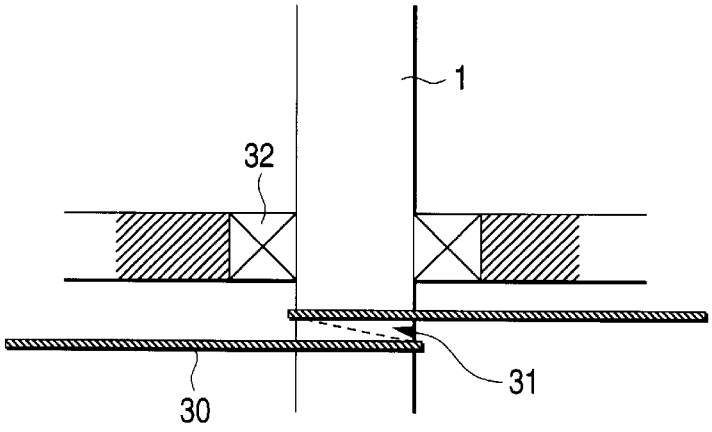
FIG. 19 is a enlarged fragmentary view of the image forming member in the embodiment shown in FIGS. 17 and 18.
Figure 20:
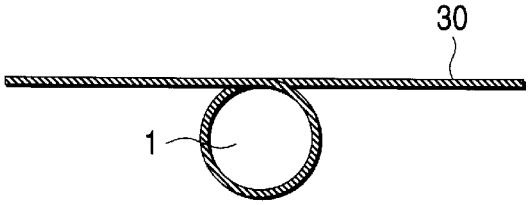
FIG. 20 is a front view of the image forming member in FIG. 19.

FIG. 19 is an enlarged schematic representation of one part of the image forming member in accordance with the embodiment shown in FIGS. 17 and 18. FIG. 20 is a front view of the same. As shown in these drawings, the outer peripheral surface of the image forming member is supported by a bearing 32, and the wire 30 that is an endless line-like drive force transmission member is wrapped around the outer peripheral surface of a driven portion 31 which is a part of the image forming member, whereby the image forming member 1 is driven in a rotating manner.

Figure 21:
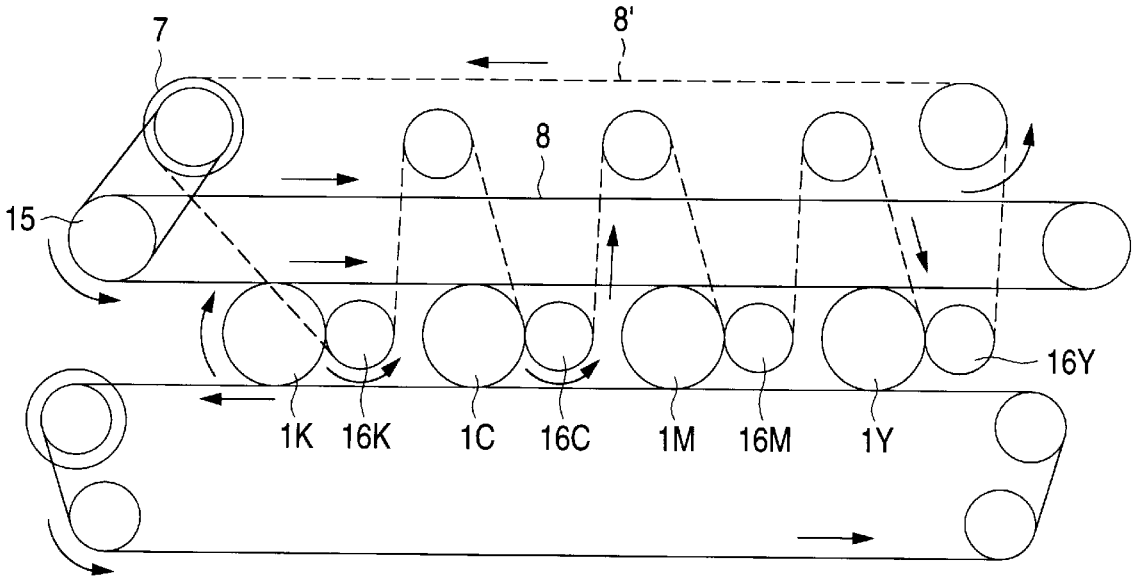
FIG. 21 is a schematic representation showing another embodiment of the drive force transmission mechanism for driving the image forming member in a rotating manner.

FIG. 21 is a schematic representation showing another embodiment of the drive force transmission mechanism which drives the image forming member in a rotating manner.

In FIG. 21, the image forming members 1Y, 1M, 1C, 1K are driven in such a way that the torque is transmitted from the motor to the image forming members 1Y, 1M, 1C, 1K by the drive roller 7 which rotates upon receipt of torque from a single motor (not shown); the endless drive force transmission member 8 wrapped around the drive roller 7; and a tensile force control roller 15 which wraps the endless drive force transmission member 8 around the outer peripheral surfaces of the image forming members 1Y, 1M, 1C, 1K with predetermined tensile force. In addition to the mechanism to drive the image forming members 1Y, 1M, 1C, 1K, FIG. 21 also shows a drive force transmission member 8' used for driving developing-device mug-rollers 16Y, 16M, 16C, 16K in conjunction with the drive roller 7 which rotates upon receipt of the torque from the motor. As is the case with the driving of the image forming members 1Y, 1M, 1C, 1K, torque is transmitted to the developing-device mug-rollers 16Y, 16M, 16C, 16K by wrapping the drive force transmission member 8' around the developing-device mug-rollers 16Y, 16M, 16C, 16K. As a result, a drive motor specially designed for the purpose of developing becomes unnecessary, which in turn makes it possible to eliminate rotational vibrations caused by developing devices.

Figure 22:
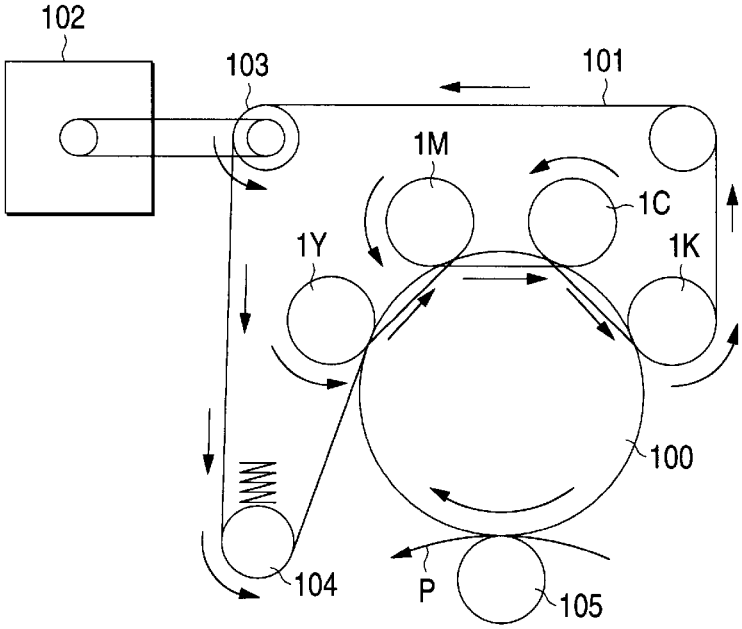
FIG. 22 is a schematic representation showing still another embodiment of the present invention.

FIG. 22 shows still another embodiment of the image forming apparatus of the present invention. The image forming members 1Y, 1M, 1C, 1K are not linearly disposed but arranged so as to surround an intermediate transfer drum 100. Paper P is nipped between the intermediate transfer drum 100 and a transfer roller 105 while it is being rotated, whereby toner images are transferred onto the paper P. In this embodiment, a wire 101 is wrapped around substantially the entire outer surface of each of the image forming members 1Y, 1M, 1C, 1K, whereby sufficient drive force is ensured. The wire 101 is driven in a rotating manner by a motor 102 via a pulley 103, and there is provided another pulley 104 for adjusting a tensile force. FIG. 22 shows the example of transmission of a drive force in which the endless wire 101 is used. However, the embodiment is not limited to the wire, but a belt may be used in place of the wire.

Figure 23:
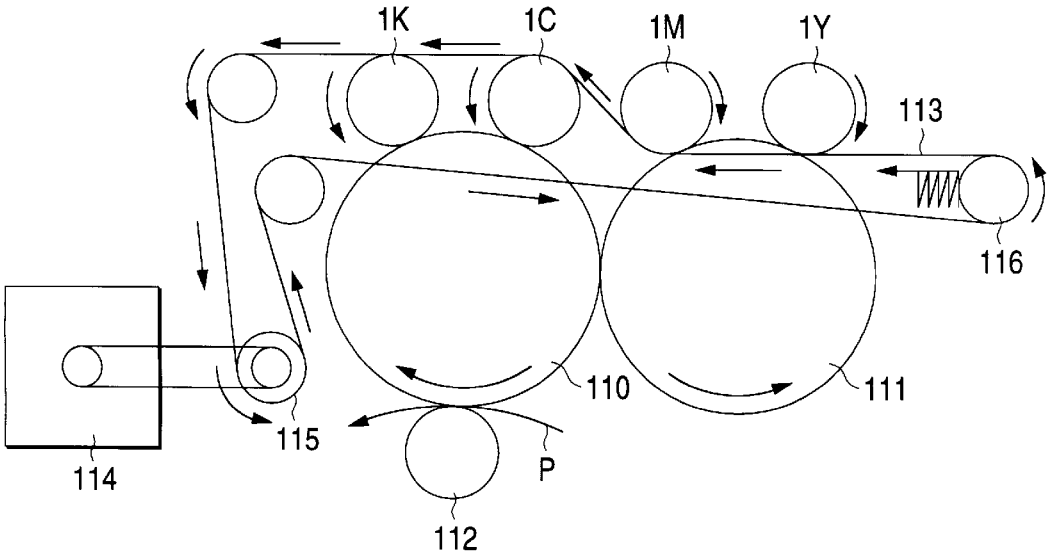
FIG. 23 is a schematic representation showing still another embodiment of the present invention.

FIG. 23 is a schematic representation showing still another embodiment of the present invention. In this embodiment, the image forming members 1Y, 1M, 1C, 1K are linearly arranged, and two intermediate transfer drums 110, 111 are disposed. Two color toner images are transferred to the intermediate transfer drum 110 from the intermediate transfer drum 111, and all the toner images are finally transferred to the paper P by means of a bias transfer roller 112. Even in this embodiment, a wire 113 is wrapped around substantially the entire outer surface of each of the image forming members 1Y, 1M, 1C, 1K, whereby a sufficient drive force is ensured. The wire 113 is driven in a rotating manner by a motor 114 via a pulley 115, and there is also provided another pulley 116 for adjusting the tensile force. In this case, although the pair of image forming members 1M and 1Y and the pair of image forming members 1C and 1K rotate in the opposite directions, a transmission system can be established with a high degree of freedom, so long as the drive system employs a wire.

Figure 24:
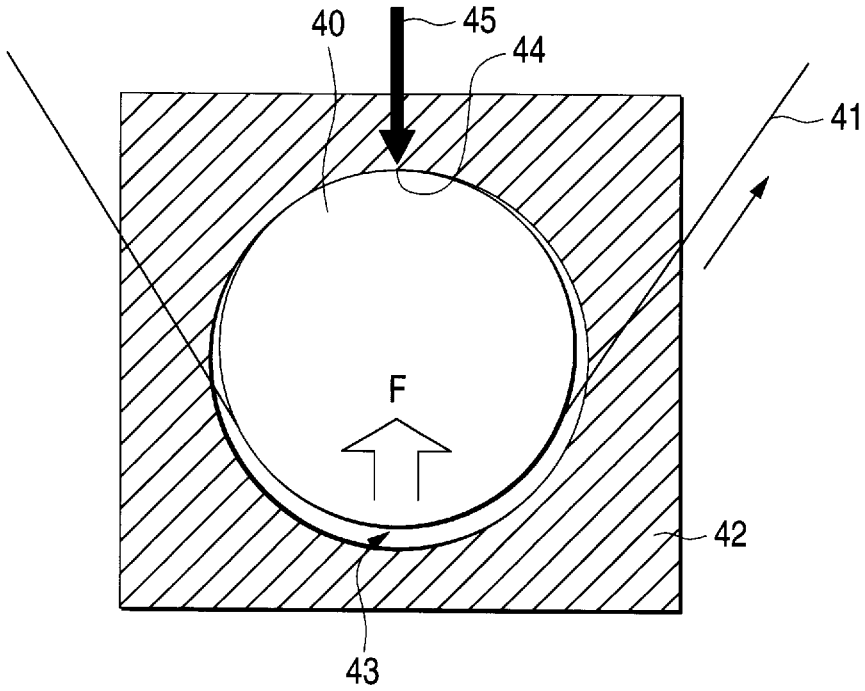
FIG. 24 is a cross-sectional view showing the image forming member supported by a bearing in accordance with the embodiment of the invention.

FIG. 24 is a cross-sectional view showing an image forming member 40 in accordance with the present invention while it is supported by a bearing 42. A belt-like drive force transmission member 41 is wrapped around an image forming member 40, and a force F acts on the image forming member 40 in an upward direction by means of a tensile force, so that the image forming member 40 comes into contact with an upper surface 44 of the bearing 42. Accordingly, even if there is a slight clearance 43 between the image forming member 40 and the bearing 42, positional variations are not caused by rotation of the image forming member 40. Although an exposure point of a laser beam 45 falls on an upper surface 44 of the image forming member 40 which is in contact with the bearing 42, it is not limited to this position.

Figure 25:
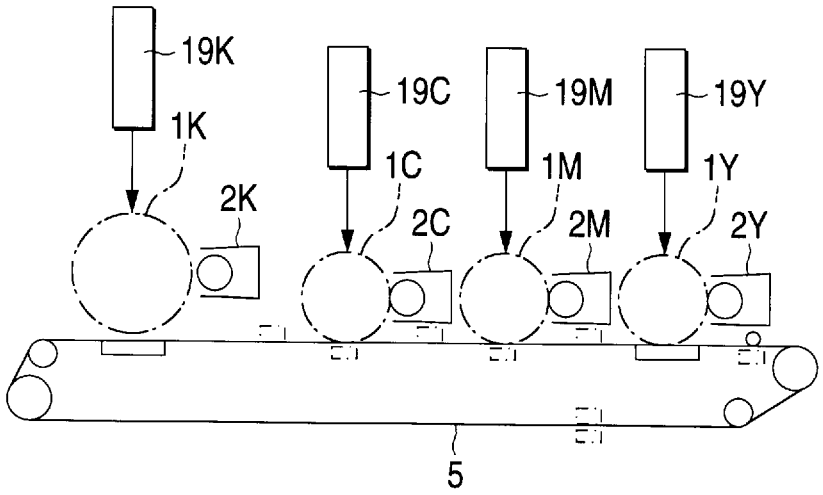
FIG. 25 is a schematic representation showing still another embodiment of the present invention.

FIG. 25 shows still another embodiment of the present invention.

In the present invention, the peripheral velocity of the image forming member can be made constant regardless of the radius of the image forming member. Therefore, in a tandem type image forming apparatus which employs a plurality of image forming members, one or a plurality of image forming members which are different in diameter from the other image forming members may be readily used. Even in this case, the peripheral velocity of all the image forming members can be made constant. In FIG. 25, the image forming members 1Y (yellow), 1M (magenta), and 1C (cyan) are formed to have the same diameter, and the image forming member 1K (black) is formed to have a different diameter. This construction is effective in a color copier which provides a monochrome copy mode as well as a full-color copy mode, because the frequency of use of the image forming member 1K is higher than those of the image forming members. If the technique of the present invention is used, the peripheral velocity of all the image forming members can be made constant without affecting the peripheral velocity of the image forming members which would be otherwise caused by the difference in deceleration rate or diameter between the image forming gears in the prior art.

Figure 26:
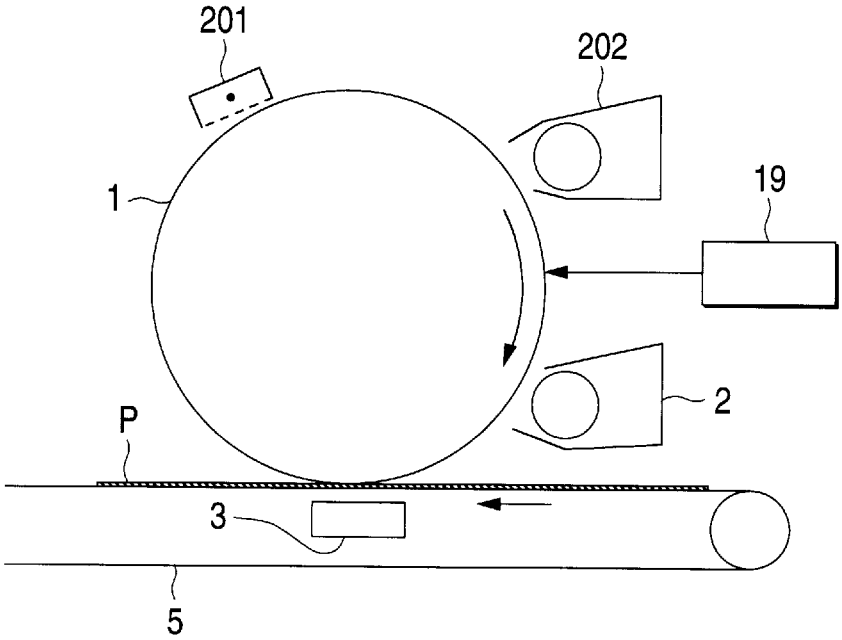
FIG. 26 is a schematic representation showing one embodiment of a cleaner-less image forming apparatus to which the present invention is applied and the periphery of the image forming member.

FIG. 26 is a schematic representation showing one embodiment of a cleaner-less image forming apparatus to which the present invention is applied and the periphery of an image forming member.

The surface of the image forming member 1 of the image forming apparatus shown in FIG. 26 is evenly electrified by a charger 201, and fine particles are imparted to the surface of the image forming member 1 before developing operation. As has been described, the image forming member 1 has supported portions, a driven portion, an image forming portion, all of which are formed from the same base member having the same diameter. The fine particles are attached to the surface of the image forming member 1 by any one of the methods; e.g., a method of mechanically attaching fine particles to the surface of the image forming member, a method of electrically attaching them, or a method which uses both the mechanical and electrical methods, so long as the method allows fine particles to be attached to the image forming member. One example of the method of mechanically attaching fine particles to the surface of the image forming member is a method which employs slidable friction; e.g., a method of effecting slidable friction through use of, e.g., a roll-shaped article, a brush-shaped article, a felt-shaped article, or a web-shaped article. The roll-shaped article includes rigid-body rollers made up of a rigid body such as metal or hard plastics, and elastic rollers made of elastic material such as rubber. In the case of a frictional nipping method, in terms of the ease of adjustment of the nipping pressure or the width of a nipping area, a resilient roller is easier to use. More specifically, the bush-shaped article includes magnetic brushes which utilize magnet or fur brushes. Fine particles can be more stably attached to the surface of the image forming member by use of the application of an electric field in conjunction with the previously-described mechanical attaching method.

The electrical attaching method also includes a method of attaching fine particles to the image forming member by means of the force of an electric field while the fine particles are dispersed like a cloud. For example, there are methods which utilize mechanical vibration, air, ultrasonic waves, or alternating electric fields; or methods in which fine particles attached to a roll-shaped article, a brush-shaped article, or a web-shaped article are rotated, vibrated, or moved. Further, there may be a method by which fine particles are sprinkled over the surface of an adhesive layer provided on the surface of the image forming member through use of the previously-described means while the fine particles are disposed like a cloud. A substance which maintains stable sticky characteristics regardless of the lapse of time is desirable as such an adhesive layer. For instance, silicon oil which exhibits stable chemical characteristics and has a low degree of volatility is desirable for use in the adhesive layer.

For example, fine particles of polymethyl methacrylate having a mean particle size of 40 nm are used as fine particles.

The fine particles can be made of another material in addition to polymethyl methacrylate; e.g., a material selected from the group of inorganic fine powder consisting of titanium oxide, alumina, silica, barium titanate, calcium titanate, strontium titanate, zinc oxide, magnesium oxide, ziconium oxide, barium sulfate, barium carbonate, calcium carbonate, silicon carbide, silicon nitride, chromium oxide, or red oxide; or from the group of organic fine powder consisting of acrylic resin, polymethacrylate, polyethylene, polypropylene, polyvinylidene fluoride, or polytetrafluoroethylene. In terms of environmental stability, it is desirable for these fine particles to be less hygroscopic. In the case of inorganic fine powder possessing the hygroscopic characteristics such as titanium oxide, alumina, or silica, they may be used after having been subjected to hydrophobic treatment. More specifically, the foregoing hygroscopic inorganic fine powder can be changed to hydrophobic by reacting it at high temperatures with a hydrophobic treatment agent, e.g., dimethyl silicon oil or silane coupling agents such as dialkyl-di-halogenated-silane, trialkyl-halogenated-silane, or alkyl-tri-halogenated-silane.

If a light-shielding effect to be described later particularly needs to be taken into consideration in terms of picture quality, acryl-based fine powder possessing superior transparency, such as acrylic resin, polymethacrylate, or polymethylmethacrylate, is desirable for use as an organic fine powder. For the case of inorganic fine powder, silica is desirable in view of the light-shielding effect. For example, stearate or magnesium stearate is apt to cause a filming phenomenon and has a strong adhesive force with respect to toner. Accordingly, a fine powder of such a material as being apt to cause a filming phenomenon is not desirable.

One type of fine particles may be attached to the image forming member, or a plurality of types of fine particles may be attached to the same at one time. It is only essential that the adhesive force developing between the toner and the image forming member can be reduced by the presence of fine particles between the toner and the image forming member.

Now, turn to the description of the image forming apparatus shown in FIG. 26.

The image forming member 1 is evenly electrified by an electric charger 201. After fine particles have been imparted to the image forming member 1 by a fine particle imparting device 202, the image forming member 1 is exposed to light by the exposure device 19 consisting of a semiconductor laser or the like, whereby an electrostatic latent image is formed on the surface of the image forming member 1. At this time, since a latent image is formed on the image forming member 1 while fine particles have been attached to the image forming member 1, it is not desirable for the fine particles to have a light shielding effect. Although the light shielding effect of the fine particles is determined by the amount of attached fine particles and the state of attachment of the fine particles in accordance with required picture quality, it is desirable that the light shielding effect be as low as possible. There are used fine particles having a transparent color or a pale color and having a size smaller than that of toner particles.

These fine particles may be attached to the toner image or may be transferred to paper while being mixed with the toner image. Therefore, it is important to prevent the toner image from being distorted or to prevent a fixed toner image from being unevenly colored or missing a color. In view of this point, fine particles having at least a particle size less than that of toner are used in the present invention. In consideration of reproducibility of fine lines or dots, it is better for the fine particles to have a smaller particle size, particularly, a particle size of less than 5 $\mu$m.

The electrostatic latent image formed on the surface of the image forming member 1 is developed to a visible image (or a toner image) by the developing device 2. This visible image is transferred to paper P by the action of the transfer device 3.

In this case, the toner is reliably positioned on fine particles as a result of the action of the fine particles, so that the toner is spaced away from the image forming member 1, or the contact area between the toner and the image forming member can be reduced. As a result, the transfer of the toner image becomes facilitated.

The paper P on which a toner image is transferred from the image forming member is supplied from a paper feed cassette (not shown) via a registration roller. The paper is conveyed to the transfer position provided downstream from the image forming member 1 while being electrostatically retained by the transfer belt 5. A toner image is transferred to the paper P, and the paper P is released from the transfer belt 5. The thus-released paper P is conveyed to a fixing unit (not shown), where the toner image is fixed on the paper P by the fixing unit.

In contrast, the image forming member 1 having finished transferring the toner image is not provided with a cleaner for removing residual toner or fine particles from the image forming member 1. Therefore, the image forming member 1 enters the next printing process while the fine particles are still attached on the image forming member 1. As a result, the effect of improving the transfer capability of toner can be maintained while the amount of fine particles to be consumed is reduced. The absence of the cleaner prevents the fine particles attached to the image forming member 1 from being forcefully pressed against the image forming member 1 by the cleaner. Consequently, there will be omitted the risk of the following problems; namely, the reduction in the transfer capability of fine particles as a result of the deformation of the fine particles, variations in the characteristics of the image forming member due to the attachment of the fine particles to the image forming member, or the abrasion of or damage to the image forming member caused by the fine particles.

In this case, the residual toner can be removed by the developing device (i.e., the developing device can double as a cleaner). More preferably, instead of the use of the developing device for removing residual toner, paper dust or other foreign substances can be prevented from being mixed with the residual toner by adoption of a development method in which a very small amount of toner returns to the developing device from the image forming member when the toner is transferred to the image forming member from the developing device at the time of photo-developing operation.

A cleaning mechanism, such as a cleaning blade, which serves as a load fluctuation factor of the image forming member can be omitted as a result of the use of the fine particles, thereby rendering a photosensitive material drive mechanism of the present invention less likely to cause variations in the speed of the image forming member according to an outer load fluctuation factor.

Figure 27:
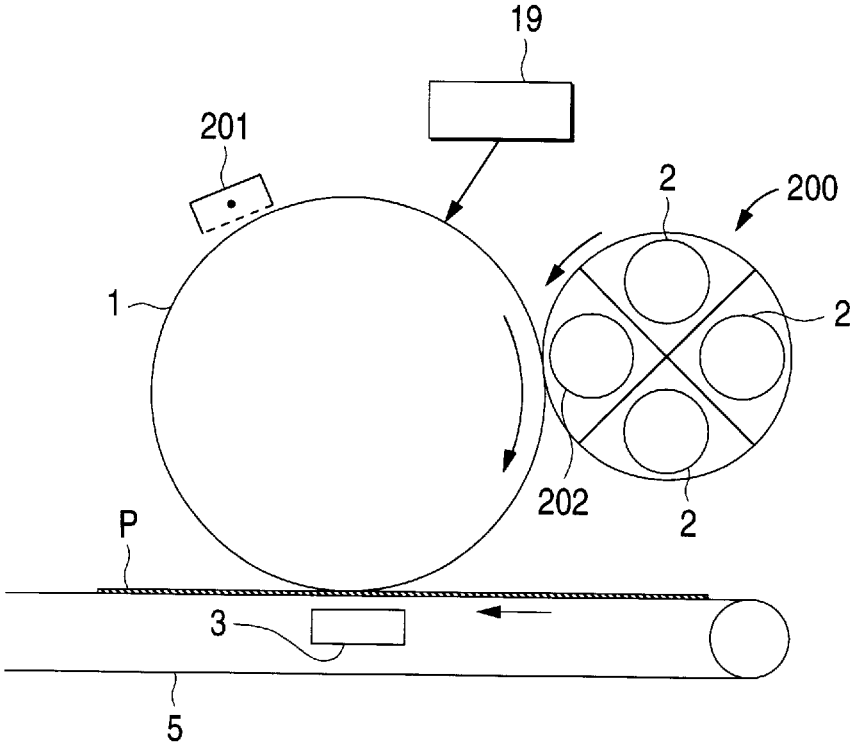
FIG. 27 is a schematic representation showing another embodiment of the cleaner-less image forming apparatus to which the present invention is applied and the periphery of the image forming member.

FIG. 27 is a schematic representation showing another embodiment of the cleaner-less image forming apparatus to which the present invention is applied and the periphery of the image forming member. An explanation will be given of the difference between the present embodiment and the embodiment shown in FIG. 26.

In the cleaner-less image forming apparatus shown in FIG. 27, after having been uniformly electrified by the electric charger 201, the surface of the image forming member 1 is exposed to light by the exposure device 19 consisting of a semiconductor laser or the like, so that an electrostatic latent image is formed on the image forming member 1. By means of a rotary-type developing/fine-particle imparting device 200 which houses fine particle imparting devices 202 and a plurality of developing devices 2, fine particles are imparted to the surface of the image forming member 1, and the latent image is developed.

Figure 28:
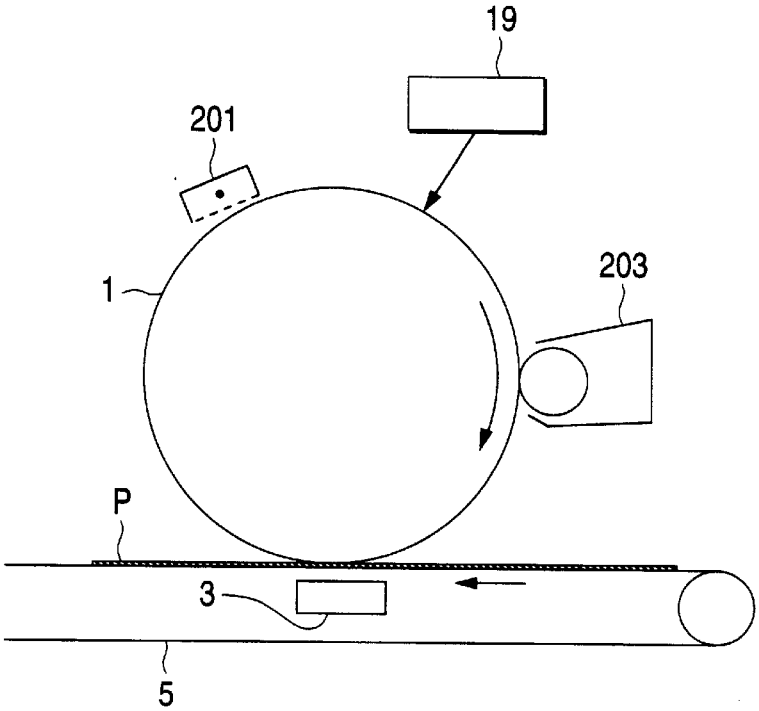
FIG. 28 is a schematic representation showing still another embodiment of the cleaner-less image forming apparatus to which the present invention is applied and the periphery of the image forming member.
Figure 29:
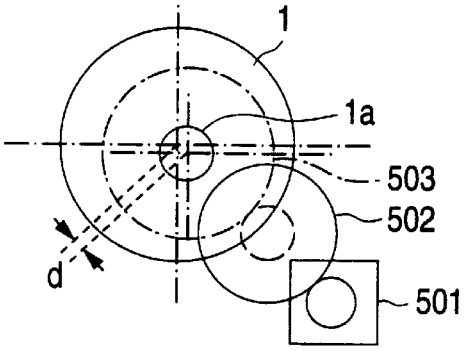
FIG. 29 (Prior Art)
FIG. 29 is a schematic representation showing a drive force transmission mechanism in the prior art.
Figure 30:
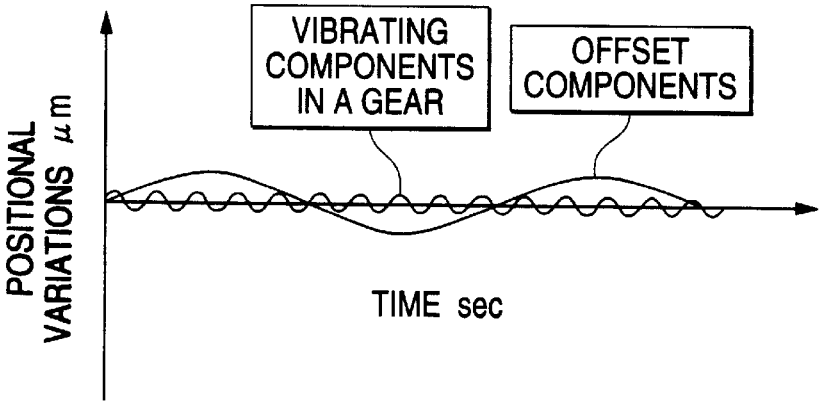
FIG. 30 (Prior Art)
FIG. 30 is a plot showing variation components developing in an image forming apparatus in the prior art.
Figure 31:
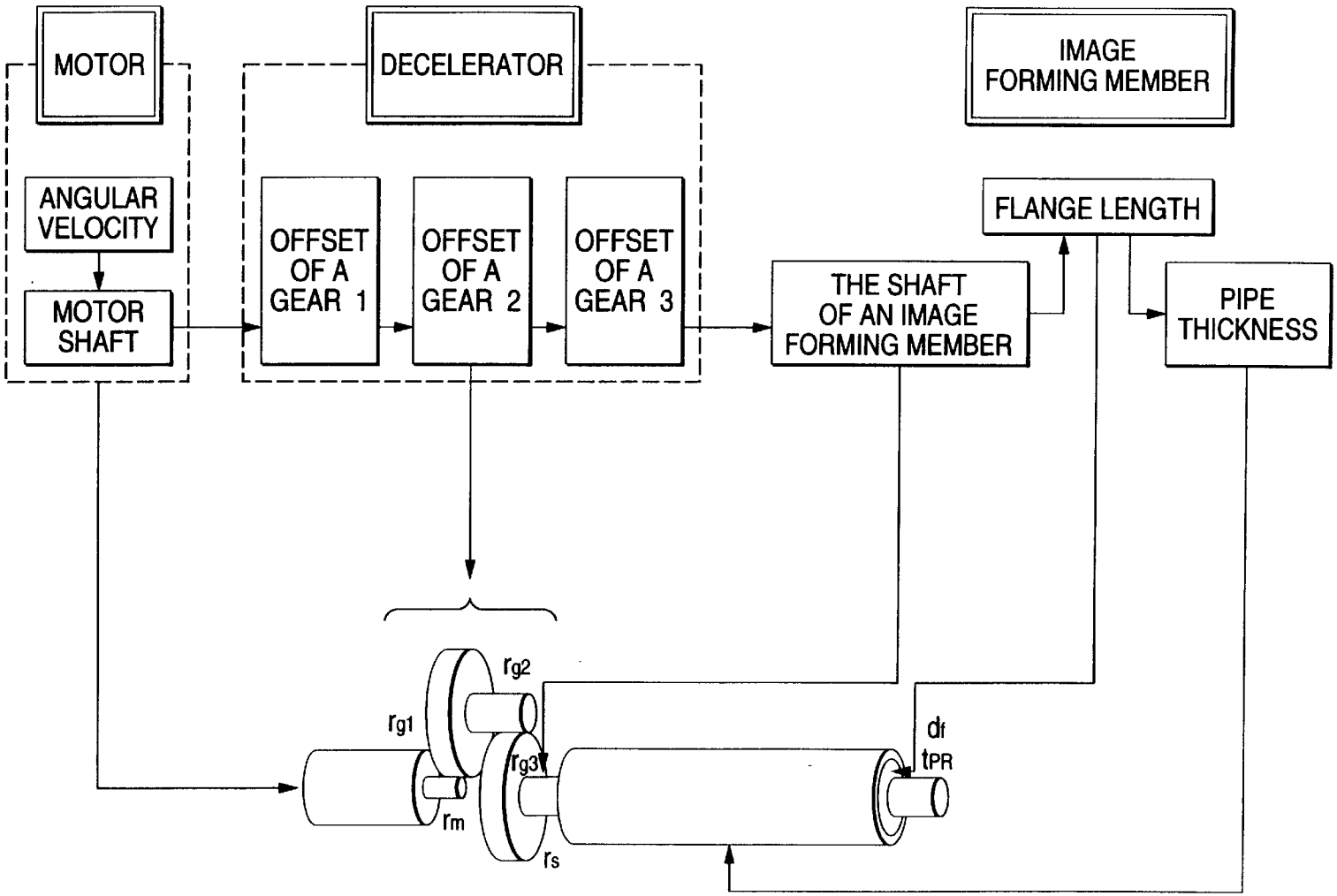
FIG. 31 (Prior Art)
FIG. 31 is a schematic representation which explains variation elements developing in the mechanism from the drive source to the surface of the image forming member in the prior art.

FIG. 28 is a schematic representation showing still another embodiment of the cleaner-less image forming apparatus to which the present invention is applied and the periphery of the image forming member. An explanation will be given of the difference between the present embodiment and the embodiment shown in FIG. 26.

In the cleaner-less image forming apparatus shown in FIG. 28, after having been uniformly electrified by the electric charger 201, the surface of the image forming member 1 is exposed to light by the exposure device 19 consisting of a semiconductor laser or the like, whereby an electrostatic latent image is formed. Subsequently, the electrostatic latent image is developed while fine particles are attached to the surface of the image forming member 1 by means of a developing device 203 which carries out development through use of toner including fine particles.

The foregoing embodiments are embodiments of the image forming apparatus which forms an image by electrophotography. The image forming apparatus of the present invention is not limited to image forming apparatuses employed electrphotography. The present invention may be widely applied to image forming apparatuses that employ rotary-drum-shaped image forming members on which electrostatic latent images, magnetic latent images, or other latent images are formed.

As has been described in detail, the present invention employs image forming members, each of which includes an image forming portion, supported portions, and a driven portion being formed from the same base member having the same diameter. As a result, offset components caused by the image forming member and offset components developing in the end portion of the decelerator are prevented from affecting the rotational speed of the image forming member, thereby enabling formation of an image without variations in density and color having superior picture quality.

What is claimed is:

1. An image forming apparatus comprising:

a drum-shaped image forming member having an image forming portion so that a latent image is formed on a surface of the image forming portion, the latent image is developed so as to produce a developed image on the surface of the image forming portion, and the developed image is finally transferred to a predetermined substrate, while the image forming member is rotating in a predetermined direction, a bearing which directly rotatably supports the image forming member, and a drive system, wherein the image forming member further comprises a supported portion being directly rotatably supported by the bearing and a driven portion being imparted a drive force by directly movably contacting said drive system to rotate the image forming member, said supported portion and said driven portion being formed from the same base member and having the same diameter as that of the image forming portion.

2. The image forming apparatus according to claim 1, wherein the drive system comprises a motor for generating a drive force; and an endless endless drive force transmission member which transmits the drive force to the image forming member from the motor by moving while remaining in contact with a surface of the driven portion of the image forming member.

3. The image forming apparatus according to claim 2, wherein a surface of the endless drive force transmission member which comes into contact with the surface of the driven portion is uniform in the longitudinal direction of the endless drive force transmission member, and the endless drive force transmission member transmits the drive force in a form of a frictional force to the image forming member from the motor.

4. The image forming apparatus according to claim 2, wherein the endless drive force transmission member is in contact with the driven portion in such a way that the image forming member experiences a force from the endless drive force transmission member so as to deflect in a predetermined direction, so that the supported portion presses the bearing in the predetermined direction.

5. The image forming apparatus according to claim 2, further comprising:

a plurality of image forming members respectively supported by a plurality of bearings; and the motor being shared between the plurality of image forming members;

wherein the drive system drives the plurality of image forming members by the drive force of the motor.

6. The image forming apparatus according to claim 5, wherein the endless drive force transmission member is in contact with the driven portion of each of the plurality of image forming members in such a way that the plurality of image forming members experience a force from the endless drive force transmission member so as to deflect in a predetermined direction, so that the supported portion of the plurality of image forming members press in the predetermined direction the bearings supporting the supported portion.

7. The image forming apparatus according to claim 1, further comprising fine particle imparting means which is provided on the image forming member so as to impart fine particles to the image forming member before or at the same that the developed image is formed on the image forming member.

8. The image forming apparatus according to claim 1, wherein a plurality of drum-shaped image forming members are respectively supported by a plurality of bearings, the drum-shaped image forming members being arranged side by side to each other in the direction in which the predetermined substrate is conveyed.

9. The image forming apparatus according to claim 8, wherein a single drive system imparts a drive force to all of the image forming members.

10. An image forming apparatus comprising:

a drum-shaped image forming member having an image forming portion so that a latent image is formed on a surface of the image forming portion, the latent image is developed so as to produce a developed image on the surface of the image forming portion, and the developed image is finally transferred to a predetermined substrate, while the image forming member is rotating in a predetermined direction, the drum-shaped image forming member further comprising a supported portion being rotatably supported by a bearing and a driven portion being imparted a drive force to rotate the image forming member, said supported portion and said driven portion being formed from the same base member and having the same diameter as that of the image forming portion, a motor for generating a drive force, and an endless drive force transmission member which transmits the drive force to the image forming member from the motor by moving while remaining in contact with the surface of the driven portion of the image forming member, the endless drive force transmission member being in contact with the driven portion in such a way that the image forming member experiences a force from the endless drive force transmission member so as to deflect in a predetermined direction, so that the supported portion presses the bearing in the predetermined direction.

11. An image forming apparatus comprising:

a plurality of drum-shaped image forming members, each having an image forming portion so that a latent image is formed on a surface of the image forming portion, the latent image is developed so as to produce a developed image on the surface of the image forming portion, and the developed image is finally transferred to a predetermined substrate, while each image forming member is rotating in a predetermined direction, each drum-shaped image forming member further comprising a supported portion being rotatably supported by a bearing and a driven portion being imparted a drive force to rotate the image forming member, said supported portion and said driven portion being formed from the same base member and having the same diameter as that of the image forming portion, a motor shared between the plurality of drum-shaped image forming members for generating a drive force, and an endless drive force transmission member which transmits the drive force to the image forming members from the motor by moving while remaining in contact with the surface of the driven portion of each image forming member, the drive force transmission member being in contact with the driven portion of each of the plurality of image forming members in such a way that the plurality of image forming members experience a force from the endless drive force transmission member so as to deflect in a predetermined direction, so that the supported portion of each of the plurality of drum-shaped image forming members presses in the predetermined direction the respective bearing supporting the supported portion.

* * * * *